US005088946A

United States Patent [19]

Nakayama

[11] Patent Number: 5,088,946

[45] Date of Patent: Feb. 18, 1992

[54] MARINE PROPULSION UNIT

[75] Inventor: Manabu Nakayama, Hamamatsu, Japan

[73] Assignee: Sanshin Kogyo Kabushiki Kaisha, Hamamatsu, Japan

[21] Appl. No.: 604,584

[22] Filed: Oct. 25, 1990

[30] Foreign Application Priority Data

Oct. 25, 1989 [JP] Japan ..... 1-276073

[51] Int. Cl.[5] ..... B63H 5/12

[52] U.S. Cl. ..... 440/61; 440/900; 248/640

[58] Field of Search ..... 440/49-53, 440/55-65, 76-78, 88, 89, 900; 248/640-642

[56] References Cited

U.S. PATENT DOCUMENTS 2,755,766 7/1956 Wanzer ..... 440/57
3,929,089 12/1975 Lambrecht et al. ..... 440/52
4,178,873 12/1979 Bankstahl ..... 440/89

FOREIGN PATENT DOCUMENTS 642508 7/1962 Italy ..... 440/63
2082994 3/1982 United Kingdom ..... 440/61

*Primary Examiner*—Jesus D. Sotelo
*Attorney, Agent, or Firm*—Ernest A. Beutler

[57] ABSTRACT

A marine propulsion unit, for mounting on the transom of a boat, has a horizontally oriented input shaft and has a lower drive unit which is angularly tiltable in the vertical plane without movement of the engine. The configuration enables the location of the driveshaft housing and lower unit at a point further aft of the transom to keep the marine propulsion unit's center of gravity in a more aftward position, enabling an extended length exhaust system, better control and handling of the exhaust, increased torque, and an increasing overall engine efficiency. The low profile of the marine propulsion unit coupled with its far forward pivot point requires a smaller motor well space and increased visibility in the direction aft of the boat.

18 Claims, 5 Drawing Sheets

MARINE PROPULSION UNIT

BACKGROUND OF THE INVENTION

This invention relates to a marine engine and drive unit having a superior configuration enabling the trimming and tilting adjustment of the drive unit without movement of the engine, including a low profile, an aftwardly extending center of gravity and improved silencing, and enabling the tilting and trimming adjustment of the drive unit whereby the center of gravity of the propulsion unit is kept of the marine craft to improve trim.

Conventional outboard motors have a generally linear orientation due to the direct connection of the crankshaft and driveshaft. The pistons of a conventional outboard motor are typically horizontally displaced about a vertically oriented crankshaft. This linear drive orientation causes the center of gravity of the conventional outboard motor to be located relatively high and relatively close to the transom of the boat onto which it is attached.

In addition, and particularly due to the shorter configuration resulting from a linear drive arrangement, a relatively short exhaust path present in conventional outboard motors increases the noisiness of the engine and does not permit optimum tuning for the best performance. This is particularly true in the case of a two cycle engine.

In conventional units, since the points of attachment of the outboard motor to the boat is primarily aft of the transom, the conventional outboard motor has to be more limited in its range of movement to accommodate space restrictions which may be encountered for different types of boats. Conversely, boats utilizing conventional outboard motors must have large motor wells to accommodate an array of different outboard motors, each having an intrusive tilt characteristic.

One way to mitigate the unwanted attributes described above is with a configuration known as an inboard/outdrive marine unit. However, the inboard/outdrive requires a hole to be cut in the transom and a special support for the engine which typically lies near the base of the hull. Such a solution is not a solution for outboard motors, but in reality an entirely different type of marine propulsion unit.

SUMMARY OF THE INVENTION

A marine propulsion unit, for mounting on the transom of a boat, has a horizontally oriented input shaft and has a lower drive unit which is angularly tiltable in the vertical plane without movement of the engine. The configuration enables the location of the driveshaft housing and lower unit at a point further aft of the transom to keep the marine propulsion unit's center of gravity in a more aftward position, enabling an extended length exhaust system, better control and handling of the exhaust, increased torque, and an increasing overall engine efficiency. The low profile of the marine propulsion unit coupled with its far forward pivot point requires a smaller motor well space and increased visibility in the direction aft of the boat.

DETAILED DESCRIPTION OF THE PREFERRED EMBODIMENT

Figure 1:
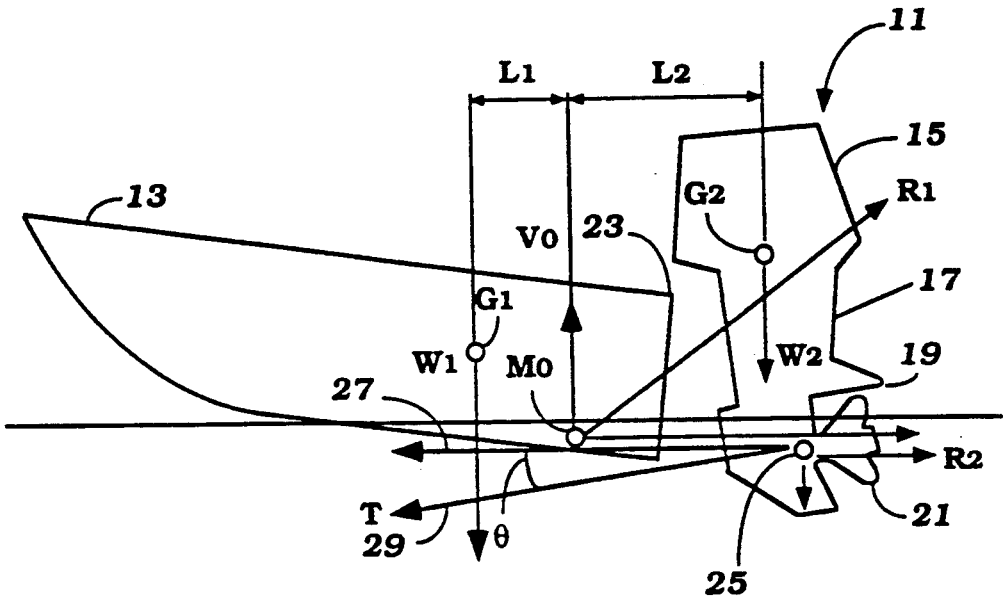
FIG. 1 illustrates the relative location of a conventional marine propulsion unit with respect to a boat.

Referring to FIG. 1, a standard propulsion unit 11 is shown in relationship to a boat 13. Marine propulsion unit 11, also known as an outboard motor, has a power head portion 15, and a drive unit including a driveshaft portion 17, and a lower unit portion 19, including propeller 21. The power head 11 is disposed above the driveshaft housing 17 and partially over the boat's transom, whose position is generally designated by the numeral 23.

In FIG. 1, the weights and centers of gravity of the conventional propulsion unit 11 and boat 13 are shown in schematic form. A vertical weight vector line $W_1$ on boat 13 defines the weight of boat 13 through its center of gravity, designated by a small circle along the length of vertical weight vector line $W_1$, the center of gravity labeled $G_1$. Conventional marine propulsion unit 11 has a vertical weight vector line $W_2$ and a center of gravity indicated by a small circle along the length of vertical weight vector line $W_2$, center of gravity $G_2$. On boat 13, a vertical $V_0$ extends through a point $M_0$ and forms the distance $L_1$, which is the horizontal distance between $V_0$ and $W_1$ and $L_2$ representing the horizontal distance between $V_0$ and $W_2$. $M_0$ is the central moment point selected for the summation of forces acting on boat 13. $M_0$ is the point about which forces acting on boat 13 are considered to be centered. These forces include the buoyancy force due to the water displaced by the aft portion of boat 13, and the drag forces due to the resistance of forward motion. The resultant force on the hull of boat 13 is labeled $R_1$.

On lower unit 21 of conventional propulsion unit 11 is a point 25 in this case in the vicinity of a propeller shaft (to be shown later). From center line 25 a pair of vectors extend in the forward direction with respect to boat 13. Vector 27 represents the forward velocity of boat 13 as it travels through the water. Vector line 29 represents the angle of thrust of propeller 21. The angle formed between these two vectors is labeled "theta," and is the angle of deviation of the thrust direction 29 from the direction of travel 27.

The greater the angle of deviation, or theta, the greater the inefficiency of operation of marine propulsion unit 11. The angle theta represents a portion of the energy which is spent holding boat 13 in trim, rather than providing energy for forward travel. The angle of deviation is large because the center of gravity $G_2$ of conventional marine propulsion unit 11 is located high and close to transom 23. Center of gravity $G_2$ of marine propulsion unit 11 is not located sufficiently aft of boat 13 to provide the required weighted balancing force against point $M_0$ to enable boat 13 to naturally achieve a state of trim. As a result, thrust vector 29 is oriented in a somewhat downward position to compensate for the lack of weighted force. Note the somewhat elevated direction in which resultant $R_1$ is directed.

Figure 2:
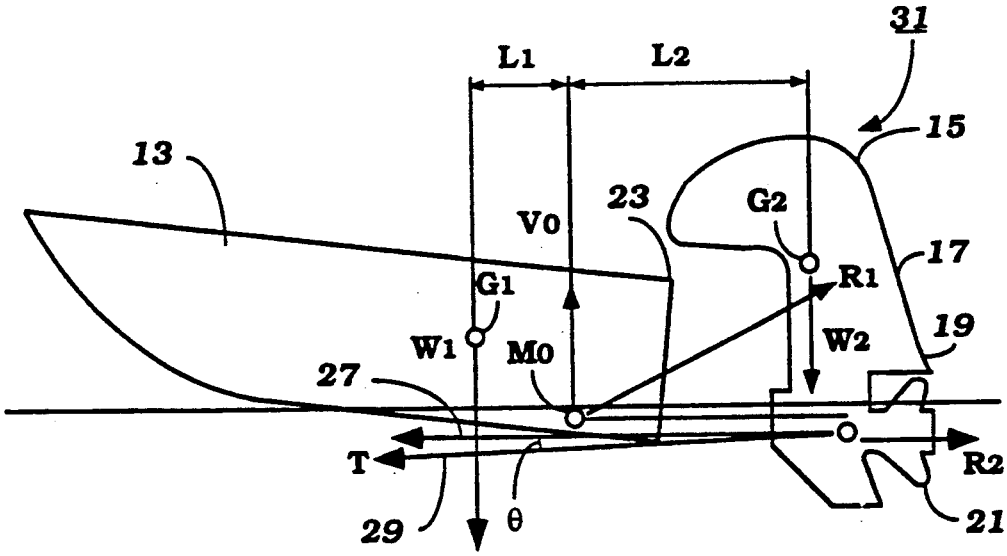
FIG. 2 illustrates the relative location of the marine propulsion unit of the present invention with respect to a boat.

Referring to FIG. 2, the marine propulsion unit 31 of the present invention is similarly illustrated with respect to a boat 13. As in the case of a conventional marine propulsion unit 11, marine propulsion unit 31 has a power head 15 and driveshaft housing 17, a lower unit 19, and a propeller 21. Marine propulsion unit 31 also has a center of gravity $G_2$ on a weight vector $W_2$. All of the quantities for boat 13 and for the centering of moments about $M_0$ are the same as those for FIG. 1. Note that center of gravity $G_2$ is located further aft and somewhat lower with respect to transom 23. Note that the overall height of marine propulsion unit 31 of the present invention is somewhat lower with respect to transom 23 than was the case for the conventional marine propulsion unit 11 of FIG. 1. Note the distance $L_2$ between weight vector line $W_2$ of marine propulsion unit 31 and vertical $V_0$. The positioning further aft of the center of gravity $G_2$ provides a more natural force for enabling boat 13 to achieve trimming orientation. Note that angle theta between direction of travel vector line 27 and thrust vector line 29 is much smaller for FIG. 2 than was the case for FIG. 1. The configuration of marine propulsion unit 31 of FIG. 2 enables less energy to be spent for the achievement of trimming position enabling more energy to be utilized in the forward movement of boat 13. This indicates that less force is employed pushing the aft portion of the boat in a downward direction and more force is employed propelling the boat 13 forward.

Figure 3:
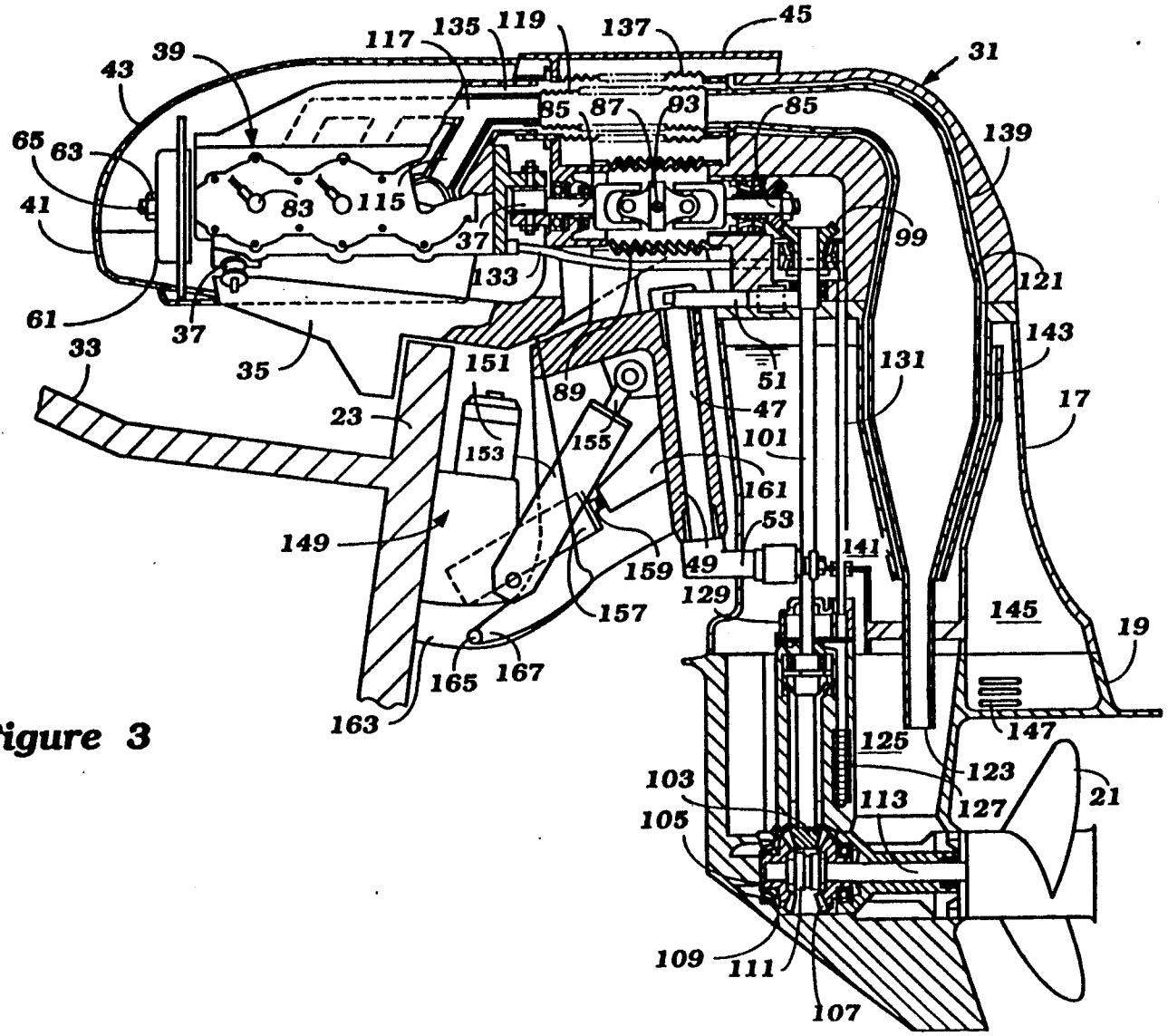
FIG. 3 is a side cross sectional view of the marine propulsion unit of the present invention in its normal running position.
Figure 4:
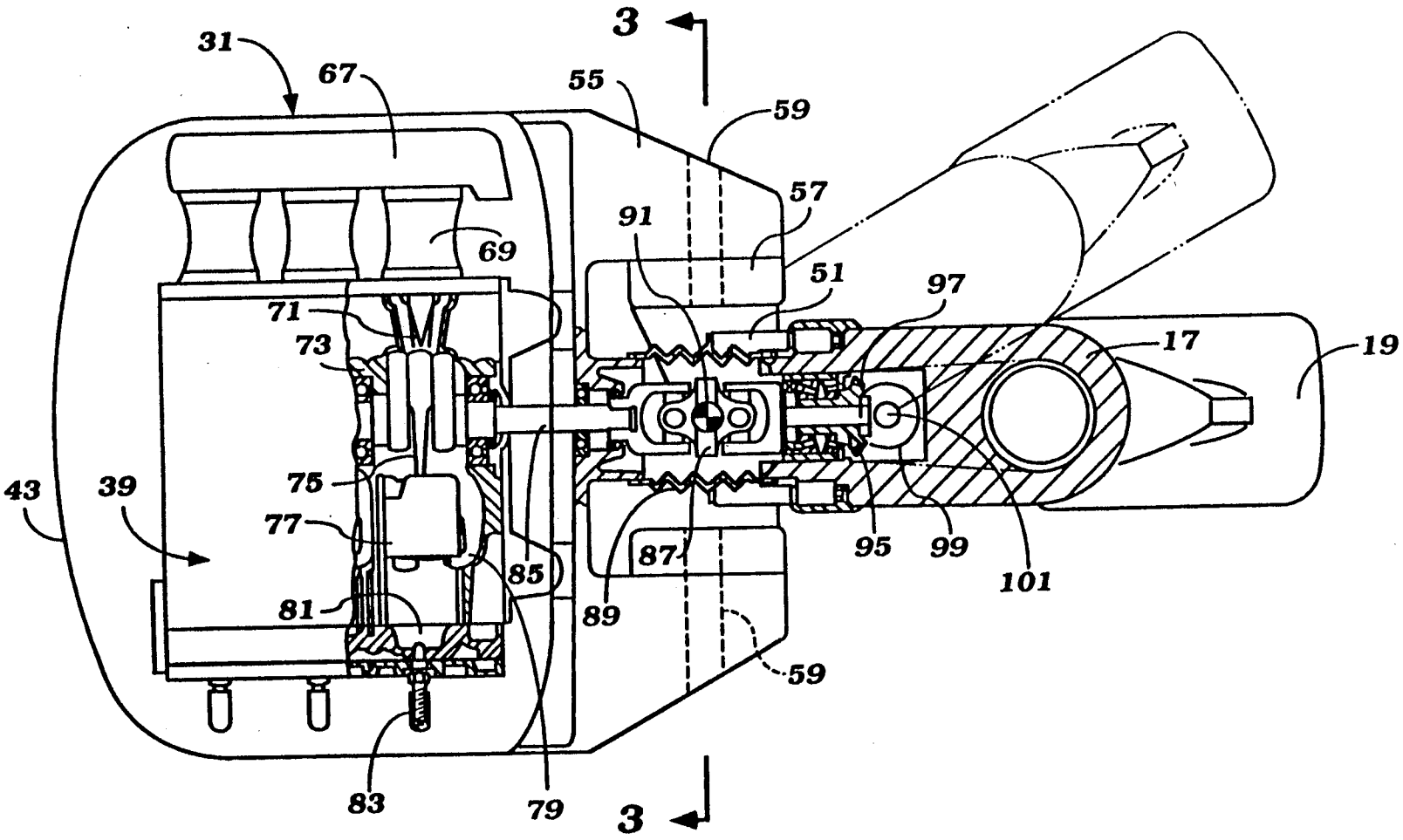
FIG. 4 is a top sectional view of the marine propulsion unit illustrated in FIG. 3.
Figure 5:
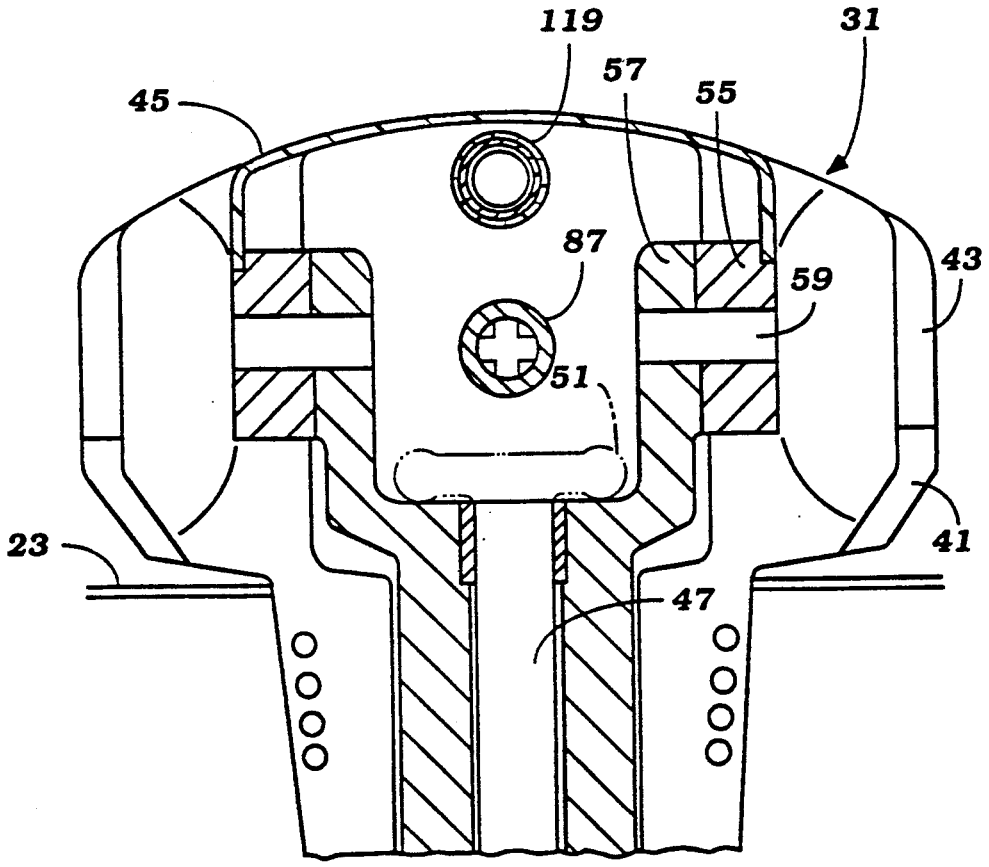
FIG. 5 is a section taken along line 5—5 of FIG. 4.

Referring to FIG. 3, the internal details and configuration of the marine propulsion unit 31 of the present invention will be explained in great detail. The systems of marine propulsion unit 31 cooperate in a synergistic manner to produce an outboard engine having a low profile, low center of gravity, an aftwardly oriented center of gravity, an extended exhaust system having increased efficiency and silencing, and a reduced space requirement. In FIGS. 3-6, the marine propulsion unit 31 of the present invention is illustrated in operating position, attached to the transom 23 of a boat. The systems of marine propulsion unit 31 which cooperate to provide a superior outboard motor, include the structural support and steering system, the mechanical power transmission system, the cooling system, the exhaust system, and the tilt system. Each of these systems will be explored in order to familiarize the reader with the manner in which they ar cooperatively engaged by the marine propulsion unit 31 of the present invention.

With regard to structural support, marine propulsion unit 31 is adapted to be attached to transom 23 of a boat 13, of FIGS. 3, 4, 5 and 6. Forward of transom 13 is a motor well 33 which not only provides some support to transom 23, but is the space within which the marine propulsion unit 31 of the present invention must limit its movement. Motor well 33 usually includes side boundaries, as are well known, but they are not illustrated in the figures. Secured to transom 23 is a clamp bracket 35, which is usually attached to transom 23 by clamps (not shown in the figures). Attached to clamp bracket 35 is a series of resilient engine mounts 37. Resilient engine mounts 37 provide support to an engine 39. Clamp bracket 35 also supports an engine cowling 41, an engine hood 43, and a moveable cover 45.

As to the steering support system, clamp bracket 35 also lends structural support to a steering shaft 47 which it supports in a swivel bracket 49. The ends of steering shaft 47 are fixed to an upper steering bracket 51 and a lower steering bracket 53. This arrangement allows driveshaft housing 17 and lower unit 19 to pivot for steering movement about the swivel bracket 49 and the clamp bracket 35. The tilt support system includes an outer tilt bracket 55, which is connected to clamp bracket 35. An inner tilt bracket 57 is tiltable about outer tilt bracket 55. Both the outer and inner tilt brackets 55 and 57 are supportably pivotable about a pair of pivot pins 59. The inner tilt bracket 57 is further connected to drive shaft housing 17.

In the power transmission system, the horizontally oriented engine 39 is depicted as a two-cycle three cylinder in this engine although other configurations are possible and occupies a space previously referred to as the power head 15, and as has been previously discussed, is supported by resilient supports 37. Engine 39 has a flywheel 61 held in place by a nut 63 on a crankshaft 65. A silencer 67 is connected to a set of three horizontally disposed side draft carburetors 69 which are in turn connected to and discharge into an intake manifold 71. Intake manifold 71 is in communication with a crankcase 73, as is typically in the case of a two cycle engine. The crankshaft 65 is slitably journaled within crankcase 73 and is driven by connecting rods 75, which are in turn connected to pistons 77. Pistons 77 cooperate into one or more scavenging ports 79 for each cylinder, which enables engine 39 to receive a combustible mixture from the crankcase 73 into a combustion chamber 81, as is well known for two cycle engines. Spark plugs 83 provide ignition of the combustible mixture in a well known manner.

During combustion, mechanical power is transmitted from the crankshaft 65 to horizontally oriented output shaft 85. Note that the entire engine assembly, including piston 77, crankshaft 65, and output shaft 85 are horizontally oriented. This horizontal orientation enables engine 39 to be brought almost entirely forward of transom 23 and enables the low profile of marine propulsion unit 31 as is readily seen from FIGS. 3, 4 and 6. Output shaft 85 is connected to a generally horizontally oriented universal joint 87. Universal joint 87 is surrounded by a power transmission bellows 89 to provide flexible covering. An area 91 of universal joint 87, as well as the steering shaft 47, lies on the steering axis of the lower unit 19 and driveshaft housing 17. An area 93 of universal joint 87, as well as the pivot pins 59, lies on the tilt/trim axis of the outer tilt bracket 55 of clamp bracket 35, about which lower unit 19, driveshaft housing 17 and swivel bracket 49 tilt. Universal joint 87 is connected to an input driveshaft 95. At the end of input driveshaft 95 is a bevel gear 97, rotatable about a horizontal axis which engages a bevel gear 99 rotatable about a vertical axis. Bevel gear 99 is connected to one end of driveshaft 101 which extends through and is suitably journaled in driveshaft housing 17. Driveshaft 101 extends into the lower unit 19 where it is connected to a gear 103. Gear 103 engages counter-rotating gears 105 and 107 within a gear box 109. A clutch 111 is splined to a propeller shaft 113 and couples that shaft to either the gear 105 or 107 for selected forward or reverse drive. Propeller 21 is suitably fixed to propeller shaft 113 and is of a suitable type to make driving engagement with the water, such type dependent upon the load and running conditions of boat 13. Note the relative aft displacement of the driveshaft 101 and the driveshaft housing 17, which causes a more aftwardly center of gravity.

The extended exhaust system of the marine propulsion unit 31 of the present invention is best illustrated with reference to FIG. 3. In communication with each combustion chamber 81 of engine 39 is an upwardly extending exhaust port 115 that is forward of the transom 23. The exhaust ports 115 join into an exhaust manifold !17. The exhaust manifold 117 opens into an exhaust bellows 119. Exhaust bellows 119 is in communication with an exhaust muffler 121, having a horizontally extending inlet and a vertically extending body and outlet, said outlet labeled as number 123. The central part of muffler 121 forms an expansion chamber. Thus we see that noise is abated both through the right angle turn between the inlet connection with exhaust bellows 119 and with respect to the expanded body portion forming the expansion chamber. Outlet 123 opens into an exhaust chamber 125 which is in communication through a path not shown with the center portion of propeller 21. In this manner the exhaust gases are expelled through propeller 21, typically beneath the water line in order to improve silencing. The extended distance between exhaust ports 115 and the point where the exhaust gases are expelled through propeller 21 is made possible by bringing the engine 39 forward of the transom 23 while extending the driveshaft housing 17 and lower unit 19 farther aft of the transom 23.

To provide insulatory cooling water for the engine 39 and the exhaust system of the marine propulsion unit 31 of the present invention, a water jacketing system is provided. A water inlet, 127 provides water to a water pump 129. Water pump 129 pumps water through a conduit 131 and through a connected water hose 133. Water hose !33 is in communication with engine 39 through a path not shown, where it supplies water to cool the portions of engine 39 subject to heating. The cooling water exits engine 39 through a water jacket passage 135 which surrounds exhaust manifold 117. Water jacket passage 135 is connected to a water bellows 137. Water bellows 137 is connected to a water passage 139 surrounding muffler 121. Water passage 139 is in communication with a water chamber 141. Water chamber 141 comprises a transition passage 143 surrounding the passage 139 and in communication with an exit chamber 145. Exit chamber 145 contains a plurality of exit openings 147 through which the spent cooling water is expelled, thus completing its path through the cooling system.

The tilt and trim system is adjacent transom 23. A power tilt device is generally designated as 149. Power tilt device 149 has an electric motor 151 driving an oil pump (not shown) included in the power tilt device 149. Electric motor 151 is situated atop power tilt device 149. Adjacent electric motor 151 and connected to clamp bracket 35, at a point near the housing of power tilt device !49 is a tilt cylinder 153, having a tilt cylinder rod 155 pivotally attached to the upper inside portion of the driveshaft housing 17. Laterally adjacent the lower portion of tilt cylinder 153 is a trim cylinder 157 attached to power tilt device 149. Trim cylinder 157 has a trim cylinder rod 159 which makes contact with an arm !61 which is also attached to a portion of swivel bracket 49.

Note that tilt cylinder !53 is angled differently than trim cylinder 157. The tilt cylinder 153 is positioned to swing driveshaft housing 17 and lower unit 19 to a wide angle to an out of the water storage position. Trim cylinder 157 provides narrow angled trimming adjustment. Trimming adjustment is a fine adjustment made usually during cruise to achieve optimal fine angle adjustment of the lower unit 19 to adjust the quality of ride or select optimum angle of thrust of lower unit 19 for the most efficient operation. The most efficient operation will dictate a fine, or trimming adjustment based upon the loading and distribution of the loading within a boat.

Adjacent transom 23 near the base of power tilt device 149 is provided a structural member 163 of clamp bracket 35 having a stopping pin 165. An arm 167 attached to the swivel bracket 49 rests against stopping pin 165 and provides a limit from which both trim cylinder 157 and tilt cylinder 153 begin to provide a range of movement of the swivel bracket 49 and the driveshaft housing 17 and lower unit 19 and engine 43, with respect to clamp bracket 35 and engine 43. Tilt cylinder 153 also provides a shock absorbing function. When the boat is in forward motion, the tilt cylinder 153 acts as a shock absorber with respect to objects encountered by lower unit 19. In reverse, tilt cylinder 153 provides resistance to the rearward thrust of the lower unit 19.

Figure 6:
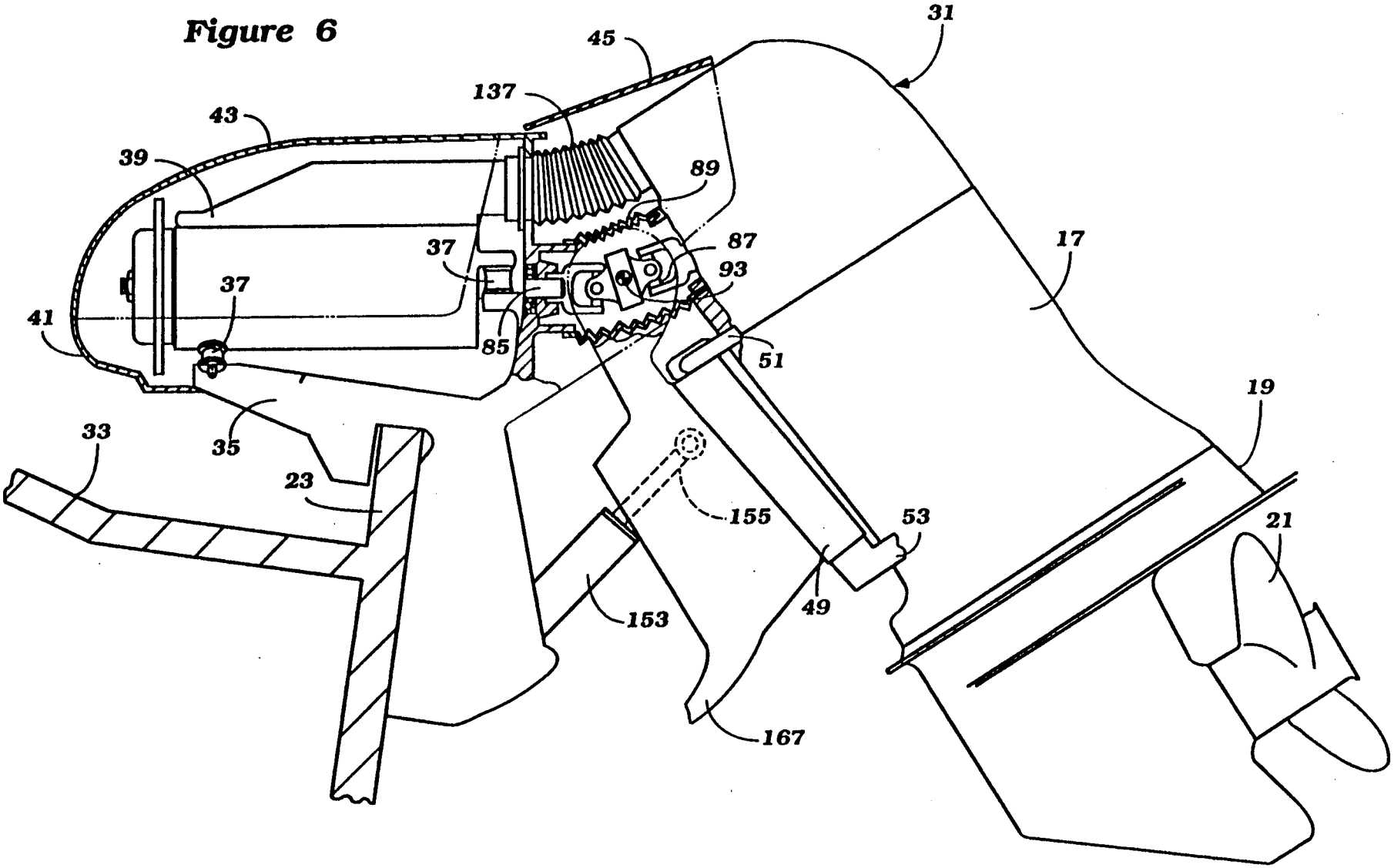
FIG. 6 is a side view of the marine propulsion unit of FIGS. 3 and 4 showing the unit tilted up.

The manner of trimming and tilting of marine propulsion unit 31 has certain advantages best illustrated with respect to FIG. 6. FIG. 6 illustrates the marine propulsion unit 31 in the tilted up out of the water position. In this position it can be seen that relative to transom 23, motor well 33, clamp bracket 35, engine 39, and engine cowling 41, that driveshaft housing 17 and lower unit 19 have changed position. No volume is displaced by engine cowling 41 and hood 43 as driveshaft housing 17 and lower unit 19 tilt upward. A portion of the tilt cylinder rod 155 is visible in extended position just above the top of clamp bracket 35. Arm 167 is swung away from engagement with stopper pin 165 (not visible in FIG. 6) which is previously shown in FIG. 3. The steerable pivoting from side to side in the plane normal to length of steering shaft 47 is still permissible during full tilt.

Referring to FIG. 3, it can be seen that the driveshaft 101 and driveshaft housing 17 generally, are displaced far aft of transom 23. The rearward displacement of driveshaft 101 and driveshaft housing 17 is enabled by the forward and horizontal orientation of engine 39 and its horizontally oriented output shaft 85. In conventional outboard motors, the engine has a vertical output shaft and must be located directly over its driveshaft.

The configuration of the marine propulsion unit 31 of the present invention also facilitates the utilization of an extended exhaust and cooling water passage which improves silencing. In a conventional marine propulsion unit, the exhaust passage has limitations based upon the shortened length of the unit. However, the marine propulsion unit 31 of the present invention has a much longer exhaust passage to facilitate the tunable adjustment of its dimension to match the frequency and throughput of the exhaust gases from engine 39. It is known that exhaust gas output creates back pressure on an engine both due to the total flowing pressure drop and to the resonance set up due to the noisiness of the exhaust. This is particularly true in two cycle engines such as the ones used in outboard motors, and of the engine utilized for marine propulsion unit 31 as presented here. A longer available exhaust path presents the opportunity to adjust the volume configuration in order to "tune" the exhaust path to improve the operating characteristic of the engine. The tuning of the exhaust path facilitates a lessened back pressure on the engine to provide greater efficiency and increased silencing.

In addition, the marine propulsion unit 31 of the present invention enables the design of a boat having a smaller motor well 33, because even in steering and tilting, the engine always keeps a generally stationary position which will derive the benefit of saving space, or the utilization of the space for other purposes. The utilization of marine propulsion unit 31 of the present invention may spawn a class of boats having smaller motor wells with more space provided for other uses.

The foregoing disclosure and description of the invention is illustrative and explanatory of a preferred embodiment of the invention, and various changes of the illustrated construction may be made without departing from the spirit and scope of the invention.

What is claimed is:

1. A marine propulsion unit for attachment as a unit to the transom of a watercraft comprising: clamping means for affixing said unit to the transom, an internal combustion engine carried by said clamping means and positioned substantially entirely forwardly of the transom when attached thereto, a first driveshaft driven by said engine and extending rearwardly from the transom, a driveshaft housing pivotally connected to said clamping means rearwardly of said transom for movement about a horizontal axis disposed rearwardly of said transom and journaling a second driveshaft for rotation about a generally vertically extending axis, means for driving said second driveshaft from said first driveshaft, and propulsion means at the lower end of said driveshaft housing and driven by said second driveshaft for propelling the watercraft.

2. The marine propulsion unit as set forth in claim 1 wherein the driveshaft housing is pivotally connected to the clamping means for pivotal movement about a generally vertically extending steering axis by a swivel bracket.

3. The marine propulsion unit as set forth in claim 2, wherein the first driveshaft includes a universal joint having a pivot axis lying on the steering axis of the driveshaft housing and also lying on the horizontal axis.

4. The marine propulsion unit as set forth in claim 2, wherein the steering axis is defined by a steering shaft fixed to the driveshaft housing and journaled in the swivel bracket.

5. The marine propulsion unit as set forth in claim 1 and wherein the first driveshaft rotates about a horizontally disposed axis.

6. The marine propulsion unit as set forth in claim 5, wherein the engine is a reciprocating engine having cylinders inclined from the vertical.

7. The marine propulsion unit as set forth in claim 6, wherein the cylinders of the engine extend in a horizontal plane.

8. The marine propulsion unit as set forth in claim 1, further including an exhaust system for exhausting the gases from the engine, including at least one engine exhaust port disposed forwardly of the transom and an exhaust conduit extending from said exhaust port rearwardly into the driveshaft housing and terminating at an under water discharge.

9. The marine propulsion unit as set forth in claim 8, wherein the exhaust system includes a muffler having a generally L-shaped configuration in side elevational view and disposed in substantial part in the driveshaft housing.

10. The marine propulsion unit as set forth in claim 8, wherein all of the engine ports are disposed forwardly of the transom.

11. The marine propulsion unit as set forth in claim 1, wherein the engine is disposed in substantial part forwardly of the transom and all of its exhaust ports are disposed forwardly of the transom.

12. The marine propulsion unit as recited in claim 1 further comprising: Tilt adjustment means, between said clamping means and said driveshaft housing, for adjusting the tilt of said propulsion means.

13. The marine propulsion unit as recited in claim 12 further comprising: Separate trim adjustment means, between said clamping means and said engine support, for adjusting the trim of said propulsion means.

14. The marine propulsion unit as set forth in claim 13, wherein the trim adjusting means is positioned rearwardly of the transom.

15. The marine propulsion unit as set forth in claim 14, wherein the trim adjusting means comprises a fluid motor.

16. The marine propulsion unit as set forth in claim 12, wherein the tilt adjusting means is positioned rearwardly of the transom.

17. The marine propulsion unit as set forth in claim 16, wherein the tilt adjusting means comprises a hydraulic motor.

18. The marine propulsion unit as recited in claim 1, wherein said internal combustion engine is resiliently mounted to said clamping means.

* * * * *